US010697259B2

(12) United States Patent
Yousef et al.

(10) Patent No.: US 10,697,259 B2
(45) Date of Patent: Jun. 30, 2020

(54) TOP DRIVE BACK-UP WRENCH WITH THREAD COMPENSATION

(71) Applicant: Nabors Drilling Technologies USA, Inc., Houston, TX (US)

(72) Inventors: Faisal Yousef, Houston, TX (US); Tommy Vu, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 146 days.

(21) Appl. No.: 15/859,607

(22) Filed: Dec. 31, 2017

(65) Prior Publication Data

US 2019/0203546 A1 Jul. 4, 2019

(51) Int. Cl.
*E21B 19/16* (2006.01)
*E21B 3/02* (2006.01)

(52) U.S. Cl.
CPC ..... *E21B 19/16* (2013.01); *E21B 3/02* (2013.01); *E21B 19/163* (2013.01)

(58) Field of Classification Search
CPC ..... E21B 19/16; E21B 3/02; E21B 19/163
See application file for complete search history.

(56) References Cited

U.S. PATENT DOCUMENTS 4,667,752 A * 5/1987 Berry ..... E21B 19/24 173/164
8,127,836 B1 * 3/2012 Keast ..... E21B 19/16 166/75.11

OTHER PUBLICATIONS

Henderson, NOV TDS-11 Top Drive cw Track System, https://hendersonrigs.com/product/nov-tds-11-top-drive-cw-track-system-p-1009.html, to the best of applicant's knowledge article was available before the application filing date, 2 pages, Henderson Rigs & Equipment, LLC Humble, TX.

* cited by examiner

*Primary Examiner* — Taras P Bemko
*Assistant Examiner* — Dany E Akakpo

(57) ABSTRACT

A back-up wrench device of a top drive assembly of a drilling rig comprises a gripper device operable to grip an end of a drill pipe, and at least one fluid actuator operable to compensate for thread travel during makeup or breakout operations. The back-up wrench device can comprise a first housing coupled to the gripper device and a second housing coupled to a support structure of the top drive assembly, and can comprise a primary hydraulic housing movably coupled to the first and second housings. The at least one fluid actuator can include upper and lower fluid actuators each movable through upper and lower fluid chambers of the primary hydraulic housing during respective makeup and breakout operations to compensate for thread travel. Associated systems and methods for thread compensation with the back-up wrench are provided.

24 Claims, 10 Drawing Sheets

TOP DRIVE BACK-UP WRENCH WITH THREAD COMPENSATION

BACKGROUND

Top drive drilling systems are well known in the art for drilling a wellbore for extracting subterranean natural resources from the earth. A top drive drilling system typically has a number of complex components including a top drive assembly supported by a derrick or drilling tower. A top drive assembly typically has a motor that rotates a main shaft that couples to a drill pipe for rotating a drill string (with a drill bit assembly) down a borehole. In some cases, the top drive assembly moves upwardly and downwardly on rails, or it can move via a cable/pulley system connected to the derrick. In either case, the top drive assembly is moved up and down about the derrick during drilling operations.

During drilling, the motor rotates the main shaft which, in turn, rotates the drill string and the drill bit assembly. Rotation of the drill bit produces the wellbore, often many miles into the earth. Drilling fluid (mud) is pumped into the top drive system and passes through an interior passage or conduit in the main shaft and through the drill string and to the drill bit assembly at the bottom of the wellbore.

In ordinary drilling operations of makeup of the top drive assembly to a drill pipe, the top drive assembly is hoisted up while pulling an unattached drill pipe for coupling to a stump (i.e., an upper end of a drill string in the earth). Once the unattached drill pipe is hoisted up and vertically oriented, a gripper device of the top drive assembly grips the female threaded end of the hoisted drill pipe. The top drive assembly rotates its main shaft (having a threaded pin/quill) clockwise for threadably mating the threaded pin of to the female end of the hoisted drill pipe while the gripper grips/positions the drill pipe. This is one "makeup" operation of the threaded pin to the drill pipe. With acme threads, for instance, about 2.5 inches of thread travel occurs during such makeup, which requires some amount of vertical travel of the top drive assembly in order to compensate for the thread travel as the threaded pin is threadably coupled to the drill pipe.

To compensate for such thread travel, existing systems utilize a simple spring configuration, whereby one or more springs are provided near the gripper assembly such that the spring(s) compress as the threads of threaded pin engage with the drill pipe. The spring(s) allow the top drive assembly to move vertically downward during threading, thereby compensating for the thread travel effectuated about the threaded pin and the drill pipe. The opposite holds true for breakout of the threaded pin from the drill pipe, whereby the spring(s) expand to compensate for thread travel during breakout operations (i.e., as the threaded pin is disengaged from drill pipe after the drill pipe has been drilled approximately 90 feet down with the drill string). Breakout is needed after the drill pipe has been drilled down a given distance so that the top drive assembly can hoist another drill pipe and repeat makeup operations.

However, such spring(s) are prone to failure because they often get clogged with mud and other debris because they are exposed to the environment. They are also unreliable and can fail due to the amount of force and torque exerted by the top drive assembly onto the drill pipe. The spring(s) configuration can delay or halt drilling operations, which is very costly and problematic. Also, the spring(s) can exert unnecessary vertical tension to threads during makeup and breakout operations of the top drive assembly to and from a drill pipe, which can shorten the life of drill pipes and their threads.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
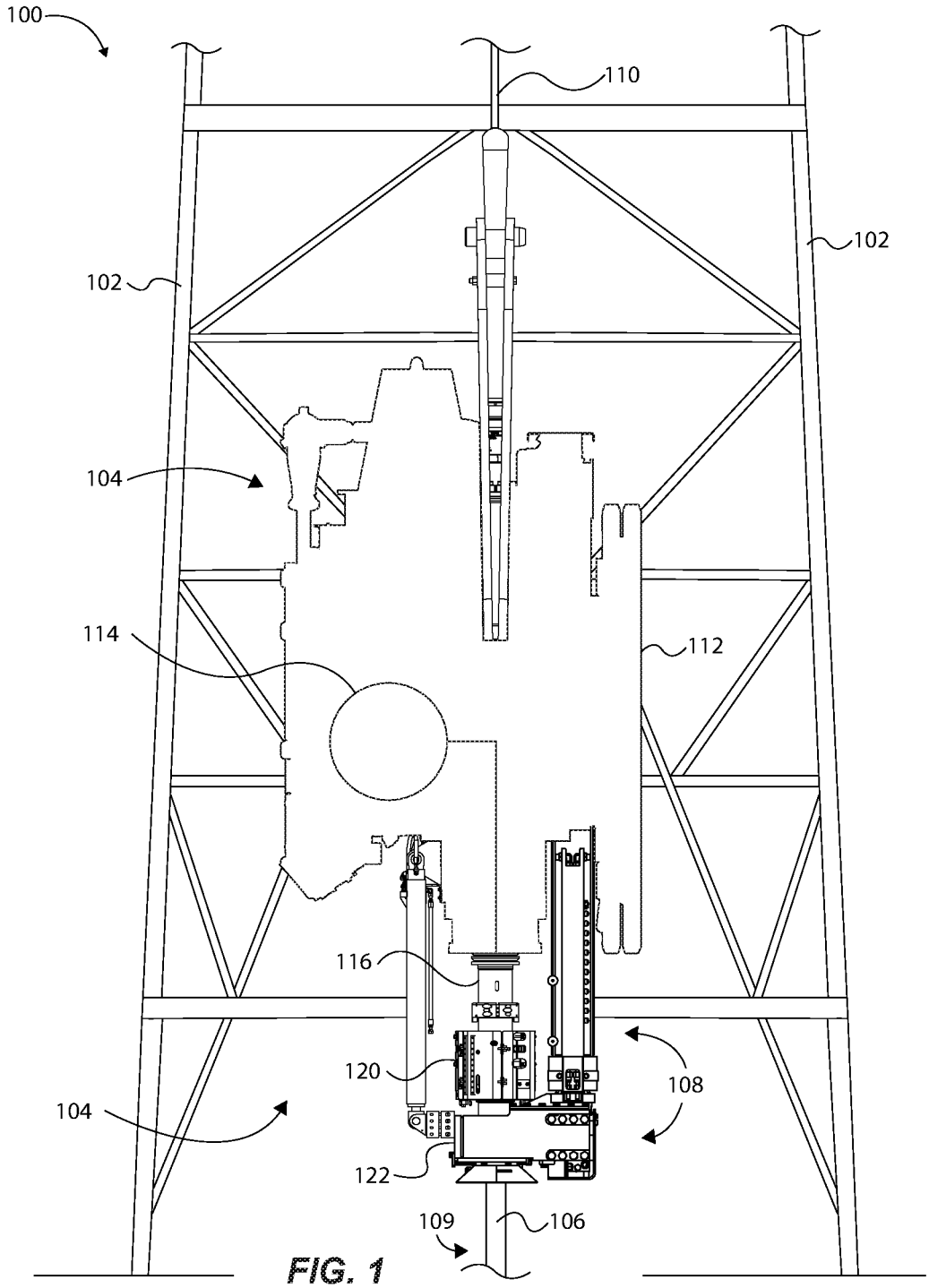
FIG. 1 is a side view of a top drive assembly having a back-up wrench and which is suspended from a derrick in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts is provided below and then specific examples are described in further detail later. This initial summary is intended to aid readers in understanding the examples more quickly, but is not intended to identify key features or essential features of the examples, nor is it intended to limit the scope of the claimed subject matter.

The present disclosure sets forth a back-up wrench device of a top drive assembly useable on a drilling rig. The back-up wrench device can comprise: a first housing coupleable to a support structure of a top drive assembly of a drilling rig; a second housing movably coupled to the first housing; a gripper device coupled to the second housing and operable to grip a drill pipe during makeup or breakout operations with the top drive assembly; and at least one fluid actuator coupled to one of the first housing or the second housing. During makeup or breakout operations, the at least one fluid actuator is movable to compensate for thread travel.

In one example, the at least one fluid actuator is configured to automatically move between the extended position and the retracted position via operation of a hydraulic system due to fluid pressure acting on the at least one fluid actuator during makeup or breakout operations.

In one example, the first and second housings are translatable relative to each other, and at least one of the first and second housings can enclose the at least one fluid actuator.

In one example, the back-up wrench comprises a primary hydraulic housing coupled to each of the first and second housings. The primary hydraulic housing comprises a lower fluid housing and an upper fluid housing fluidly separated from each other. The at least one fluid actuator can comprise a lower fluid actuator movable through the lower fluid housing, and an upper fluid actuator movable through the upper fluid housing.

The present disclosure sets forth a top drive system for use on a drilling rig comprising a top drive assembly movably coupleable to a rig support frame of a drilling rig. The top drive assembly comprises a threaded pin that is operable to rotatably engage and disengage a threaded end of a drill pipe during respective makeup and breakout operations. The top drive system comprises a back-up wrench device coupled to the top drive assembly and comprising a gripper device operable to grip the drill pipe, and at least one fluid actuator operable to compensate for thread travel between the threaded pin of the top drive assembly and the drill pipe during makeup or breakout operations.

The present disclosure sets forth a top drive system for use on a drilling rig comprising: a top drive assembly comprising a threaded pin that is operable to rotatably engage and disengage a threaded end of a drill pipe during respective makeup operations and breakout operations associated with the top drive assembly and the drill pipe, and a back-up wrench device coupled to the top drive assembly. The back-up wrench can comprise: a gripper device operable to grip the drill pipe; a first housing coupled to a support structure of the top drive assembly; a second housing coupled to the gripper device, and movably coupled to the first housing; and a primary hydraulic housing movably coupled to each of the first and second housings, and comprising an upper fluid chamber and a lower fluid chamber; an upper fluid actuator coupled to the first housing, and movable through the upper fluid chamber (the upper fluid actuator being operable from an extended position to a retracted position to compensate for thread travel between the threaded pin of and the drill pipe during makeup operations); and a lower fluid actuator coupled to the second housing, and movable through the lower fluid chamber (the lower fluid actuator being operable from a retracted position to an extended position to compensate for thread travel during breakout operations).

The present disclosure sets forth a method for thread compensation with a back-up wrench device of a top drive assembly of a drilling rig. The method can comprise: gripping a drill pipe with a gripper device of a back-up wrench of a top drive assembly; threadably engaging a threaded pin to the drill pipe during makeup operations; and facilitating movement of a first fluid actuator of the back-up wrench device from an extended position to a retracted position, upon threadably engaging the threaded pin to the drill pipe, to compensate for thread travel during the makeup operations.

The method can further comprise threadably disengaging the threaded pin from the threaded end of the drill pipe during breakout operations, and facilitating movement of a upper fluid actuator of the back-up wrench device from a retracted positon to an extended position, upon threadably disengaging the threaded pin from the drill pipe, to compensate for thread travel during the breakout operations. The method can still further comprise operating a hydraulic system to move the upper fluid actuator from the retracted position to the extended position, and between makeup and breakout operations to reset the upper fluid actuator to the extended position.

To further describe the present technology, examples are now provided with reference to the figures.

Figure 2A:
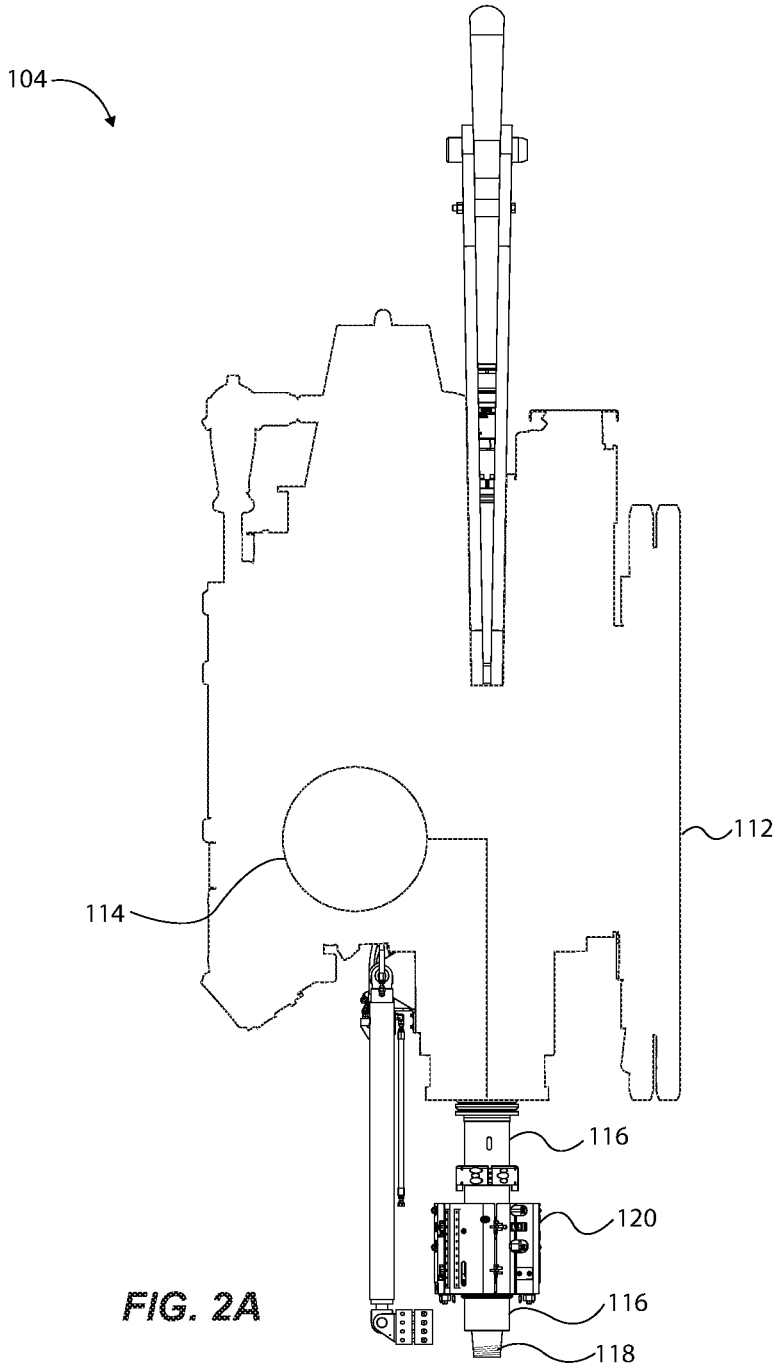
FIG. 2A is a side view of the top drive assembly of FIG. 1 without the back-up wrench.
Figure 2B:
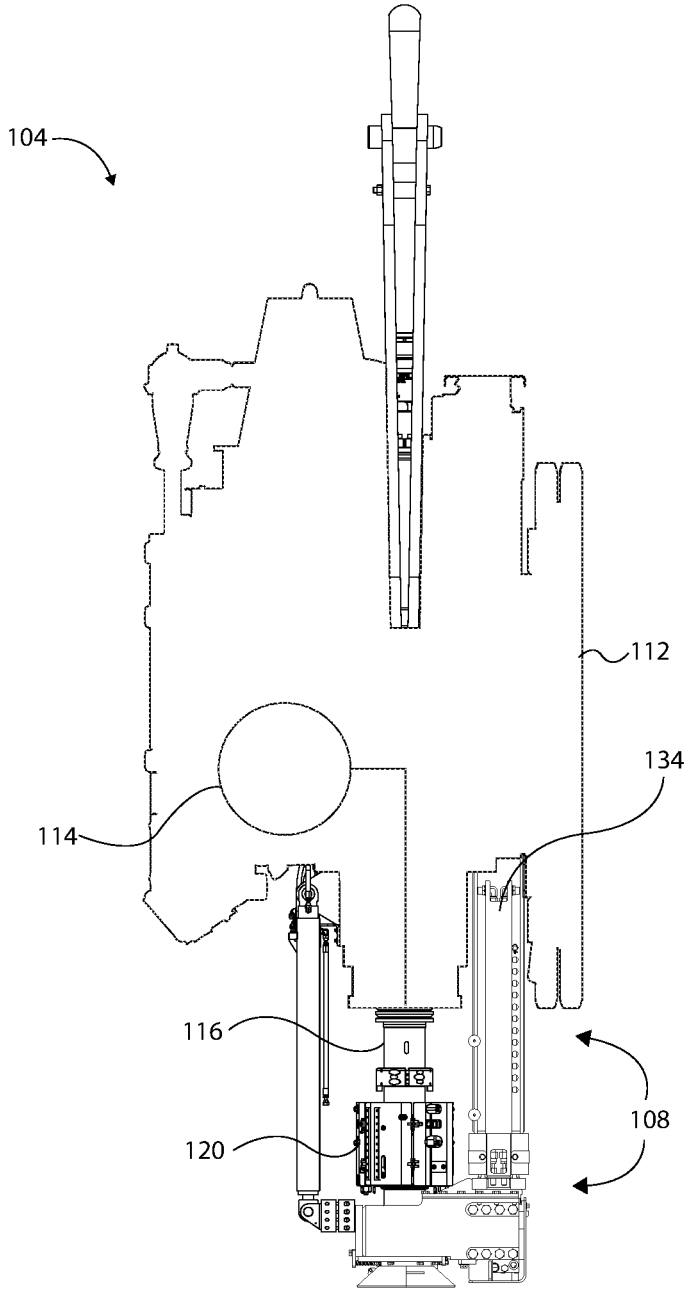
FIG. 2B is a side view of the top drive assembly of FIG. 1 with the back-up wrench.

FIGS. 1-2B illustrate a drilling rig system 100 comprising a rig support frame 102 (e.g., a derrick) and a top drive assembly 104, with a back-up wrench 108, in accordance with an example of the present disclosure. FIGS. 2A and 2B show the top drive assembly 104 isolated from the rig support frame 102, while FIG. 2A shows the top drive assembly 104 without the back-up wrench device 108 for purposes of illustration.

The top drive assembly 104 comprises or is operable with the back-up wrench device 108 for gripping a drill pipe 106 of a drill string 109 (or to be coupled to a drill string) disposed through a ground surface. Notably, the back-up wrench device 108 is configured for thread travel compensation during each of drill pipe makeup operations and breakout operations, as further detailed below.

In one example, the top drive assembly 104 is tethered to the rig support frame 102 by a cable 110, which can be coupled to a drum reel and motor (not shown) that is controlled to raise or lower the top drive assembly 104 into desired positions, as with typical drilling set ups having a top drive assembly. The top drive assembly 104 can comprise a support structure 112 that supports a variety of top drive drilling systems/components. For instance, the support structure 112 can comprise a number of steel frame supports that support a motor 114 (shown schematically) configured to rotate a main shaft 116 for rotating drill pipes of the drill string 109. Of course, at the lower end of the drill string 109 includes a drill bit assembly (not shown) for drilling a borehole.

The motor 114 rotates the main shaft 116 that rotates a threaded pin 118 (FIG. 2A) that, when coupled to the drill pipe 106, rotates the drill pipe 106 to thereby rotate the drill string 109 for drilling the borehole, Drilling fluid (e.g., mud) is pumped into the top drive assembly 104 through a mud valve 120 (or multiple mud valves), and the mud passes through interior passages along the main shaft 116, the threaded pin 118, the drill string 109, and then to the drill bit at the bottom of the borehole. As with typical mud drilling operations, a mud pump (not shown) pumps mud into the borehole in this manner, and then pumps it out for recirculation. The basic structure and operation of a top drive assembly is well known and will not be discussed in great detail. However, it will be appreciated that the top drive assembly 104 of the present disclosure can comprise a number of known devices and mechanisms to effectuate drilling operations, as discussed above.

During makeup of the threaded pin 118 to the drill pipe 106, a stump (upper end of a drill pipe of a drill string) extends from the borehole (as being previously drilled into the ground by the top drive assembly 104). Then, the top drive assembly 104 is hoisted up via the cable 110 while the top drive assembly 104 grabs and pulls another drill pipe from an inventory/stack of drill pipes. For purposes of illustration, assume drill pipe 106 was already hoisted into position for makeup of the threaded pin 118 to the drill pipe 106 during drilling operations. The back-up wrench device 108 is then utilized to assist with such makeup, as further discussed below.

Figure 3A:
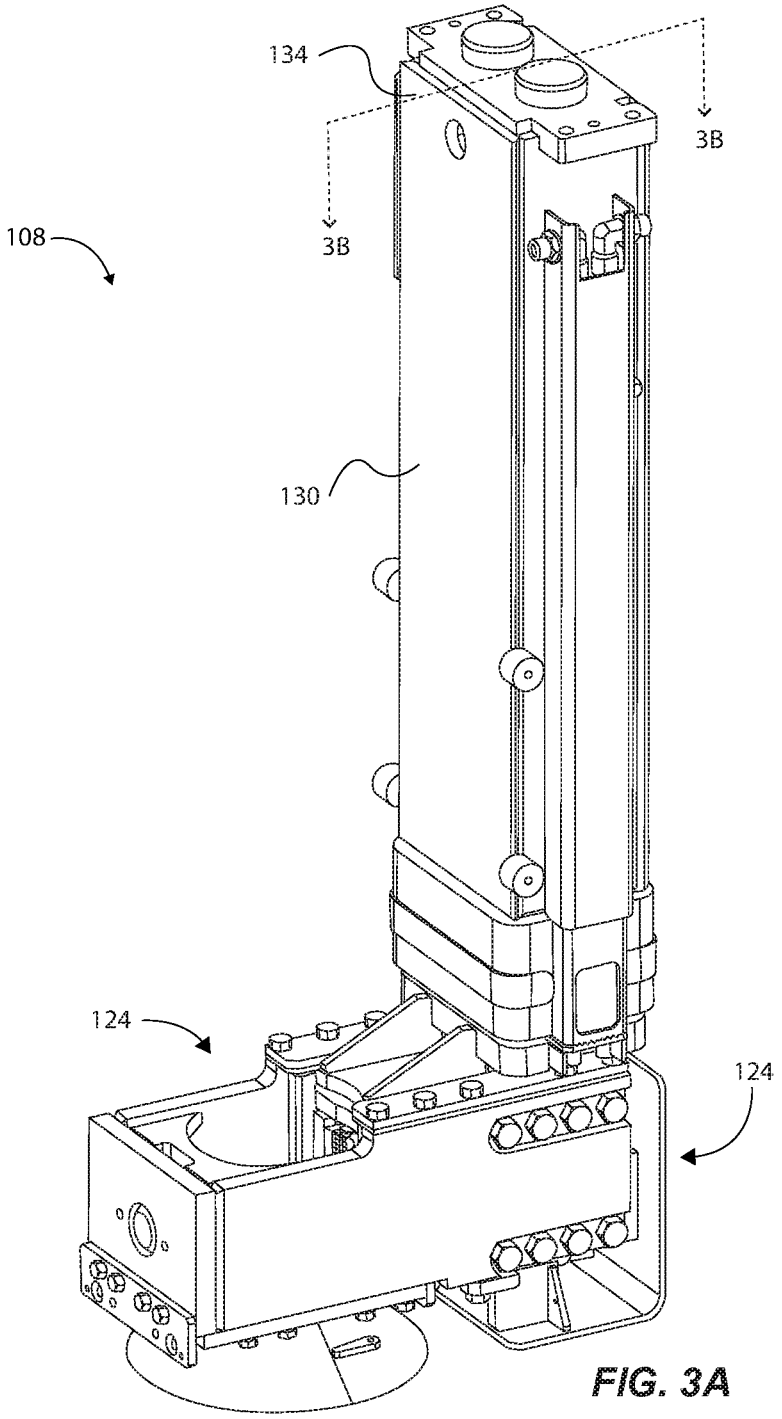
FIG. 3A is an isometric view of the back-up wrench of FIG. 1 in accordance with an example of the present disclosure.
Figure 3B:
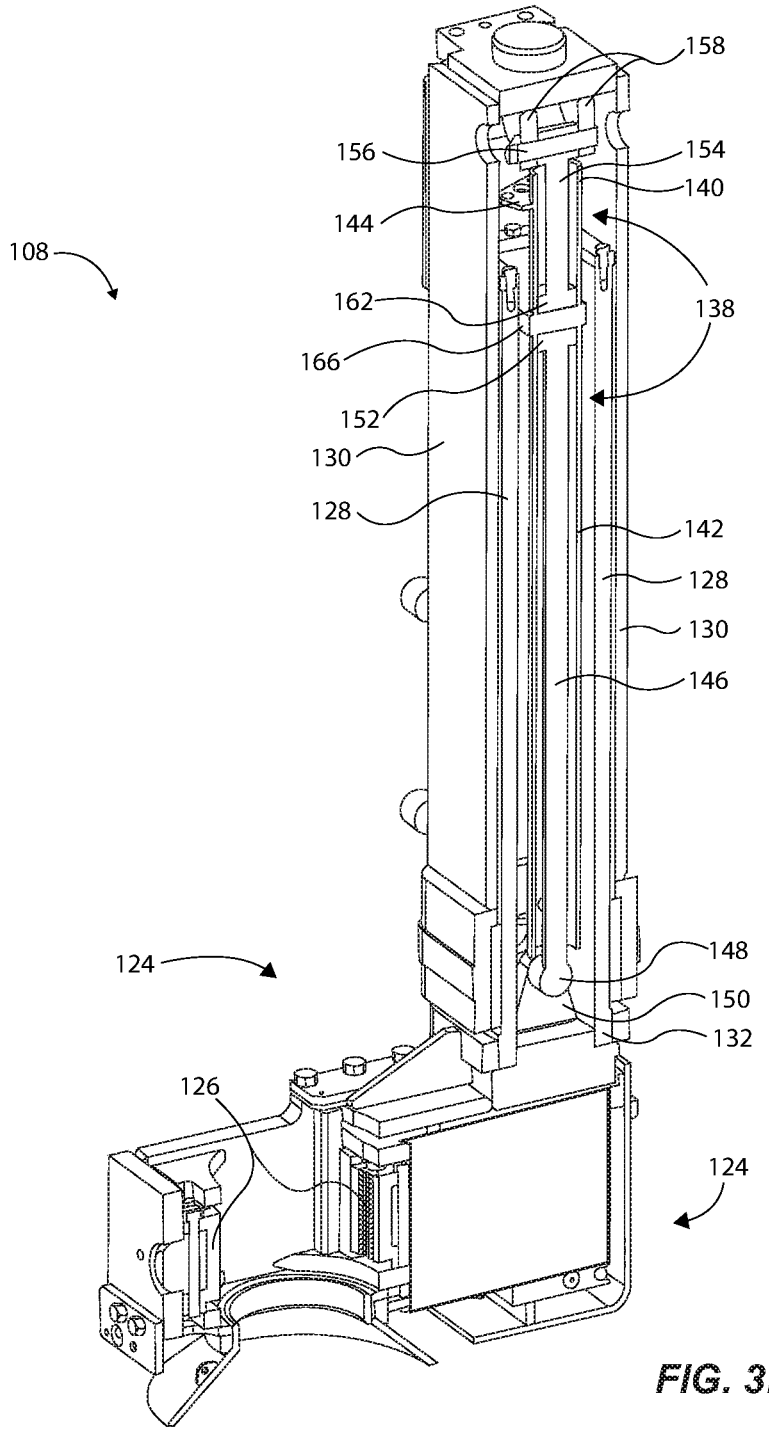
FIG. 3B is a cross sectional view of the back-up wrench of FIG. 3A along lines B-B.

FIG. 3A shows an isometric view of the back-up wrench device 108, and FIG. 3B shows a cross sectional view of the back-up wrench device 108 along lines 3B-3B of FIG. 3A. With reference to FIGS. 1-3B, the back-up wrench device 108 can comprise a gripper device 124 operable to grip an end of the drill pipe 106. The gripper device 124 can comprise gripping members 126 (e.g., in one example, see gripping members 126 in the form of gripping teeth in FIG. 3B) that can be hydraulically actuated by a hydraulic system (not shown) to grip or release the outer surface of the drill pipe 106 during makeup and breakout operations, as further discussed below.

Figure 5A:
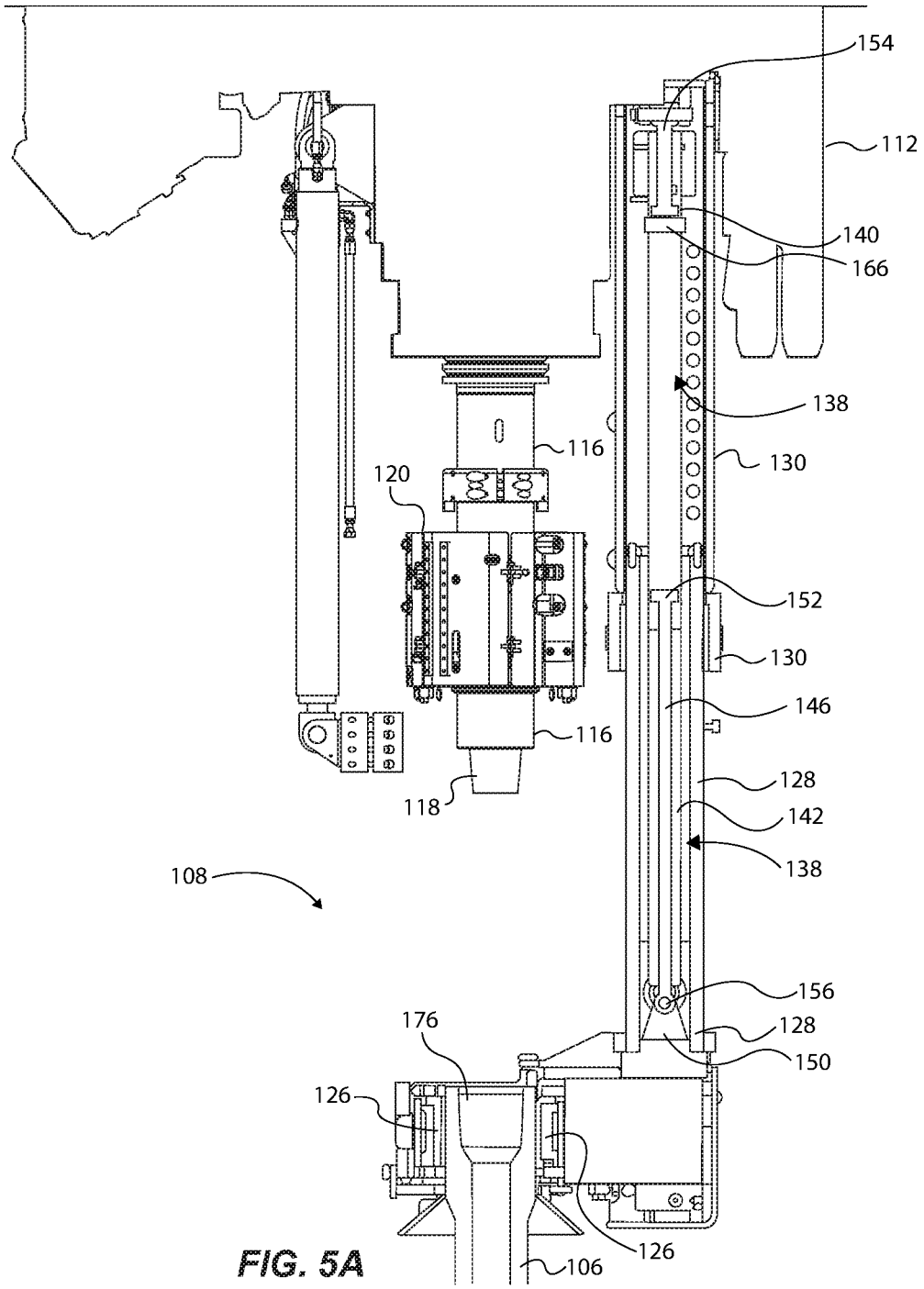
FIG. 5A illustrates a cross-sectional view of the back-up wrench of FIG. 1, with the gripper positioning actuator in an extended position.
Figure 5B:
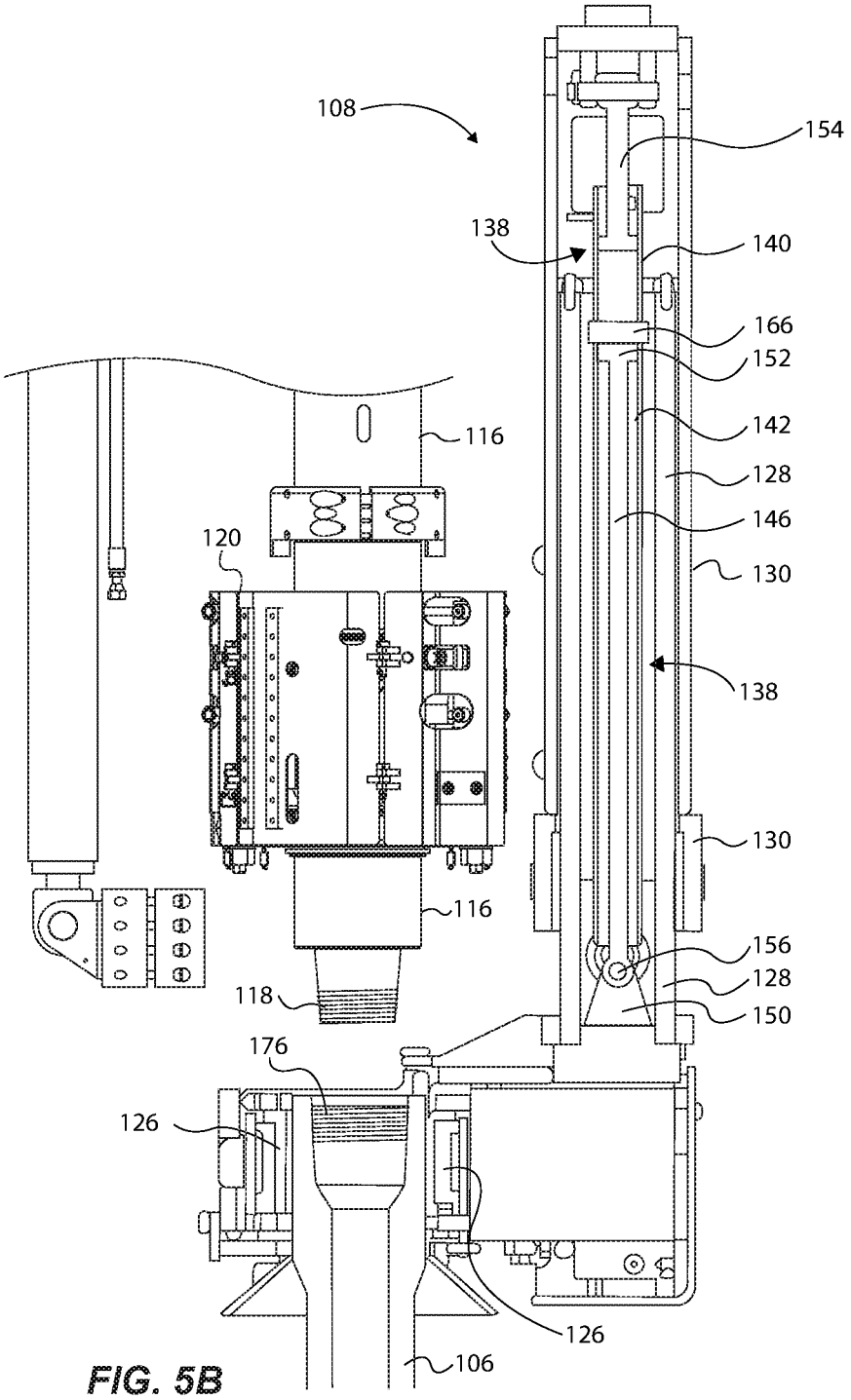
FIG. 5B illustrates a cross-sectional view of the back-up wrench of FIG. 1, with the gripper positioning actuator in a retracted position, and with the thread compensation actuator in an extended position.

In one example, the back-up wrench device 108 can comprise an inner or first housing 128 (FIG. 3B) attached to the gripper device 124 and an outer or second housing 130 coupled or otherwise secured to a portion of the support structure 112 of the top drive assembly 104 (see FIG. 1; see also FIGS. 5A and 5B showing the inner and outer housings 128 and 130). As shown in FIG. 3B, a lower end 132 of the inner housing 128 is coupled (fastened, welded, or otherwise secured) to structural support plates/frames of the gripper device 124. The gripper device 124 can include a number of plates and other structural support members bolted or welded together, for instance, to support and house various gripper mechanisms therein. In one example, as shown, the back-up wrench device 108 can comprise a somewhat L-shaped configuration to position the gripping members 126 away from the inner and outer housings 128 and 130, such that the longitudinal axis of the drill pipe 106 is generally or substantially parallel to a longitudinal axis the inner and outer housings 128 and 130. In this configuration, the thread compensation axis (the axis of movement of the components of the thread compensation device) can be offset from the longitudinal axis of the drill pipe and drill string as well as the main shaft of the top drive.

An upper end 134 of the outer housing 130 can be attached to a portion of the support structure 112 in a suitable manner, such as with bolts or other attachment or securing means. Both the inner and outer housings 128 and 130 can be comprised of steel and can each have a corresponding cross sectional area (e.g., a square or rectangular-shaped cross-sectional area), configured to resist a high amount of torque on the system during makeup and breakout operations while the gripper device 124 grips the drill pipe 106. As further discussed below, the inner housing 128 is movable or translatable axially relative to the outer housing 130, such as in a telescoping manner.

With reference to FIGS. 1-4B, the back-up wrench device 108 can further comprise a primary hydraulic housing 138 coupled to the inner and outer housings 128 and 130. More specifically, the primary hydraulic housing 138 can comprise a lower fluid housing 140 and an upper fluid housing 142 fluidly separated from each other (by a partition, as discussed below). The primary hydraulic housing 138 can comprise a positioning plate 144 secured to the upper end of the primary hydraulic housing 138 adjacent the upper fluid housing 140. The positioning plate 144 can be sized corresponding to the inner surface of the inner housing 128 and can be sized slightly smaller than the inner surface of the inner housing 128 so that, as the primary hydraulic housing 138 moves, the positioning plate 144 slides along the inner surface of the inner housing 128 to assist with properly (e.g., vertically) orienting the primary hydraulic housing 138 within the inner and outer housings 128*a* and 130. Thus, in one example, the primary hydraulic housing 138 can be movably coupled to both of the inner and outer housings 128 and 130, as will be appreciated from the below discussion.

Figure 5C:
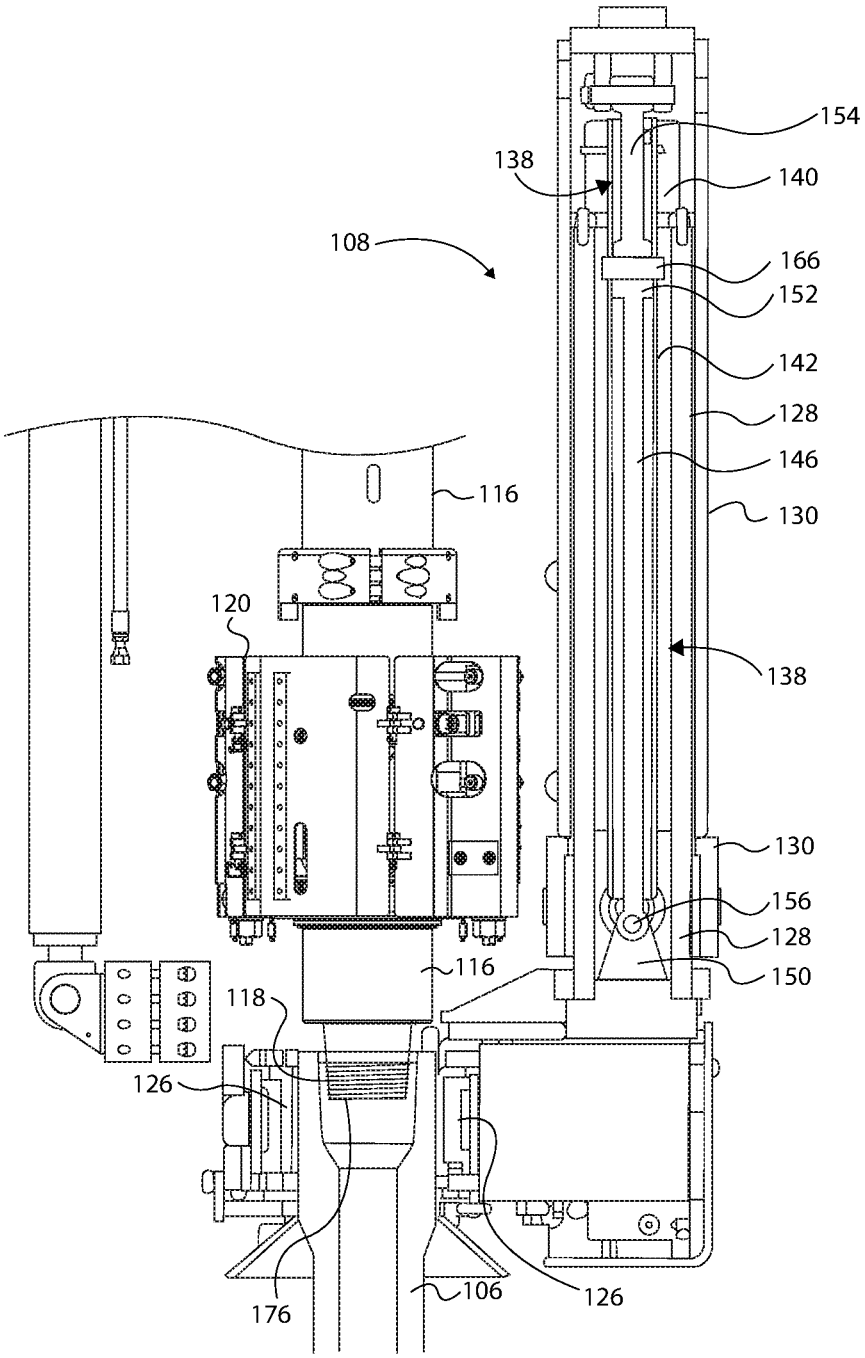
FIG. 5C illustrates a cross-sectional view of the back-up wrench of FIG. 1, with the gripper positioning actuator in a retracted position, and with the thread compensation actuator in a retracted position.

The back-up wrench device 108 can further comprise a lower or first fluid actuator 146 having one end coupled to the inner housing 128 and the other end movably disposed through the lower fluid housing 142 upon being hydraulically actuated (discussed further below regarding FIG. 5). In one example, the lower fluid actuator 146 can comprise a steel cylinder having first and second ends. The lower fluid actuator 146 can be rotatably coupled to the gripper device 124. In the example shown, for instance, the lower fluid actuator 146 can comprises, at a rod end, a coupling member 148 rotatably coupled to a pair of support flanges 150 (one shown in FIG. 3B) of the gripper device 124. Each support flange 150 can comprise an aperture configured to receive respective, and opposing protruding posts 149 (FIG. 4A) of the coupling member 148. With this arrangement, the lower fluid actuator 146 is essentially "pinned" to the gripper device 124 to allow some relative rotational movement (about a rotational axis (e.g., a z-axis (axis extending out of the page)) of the gripper device 124 relative to the support structure 112 of the top drive assembly 104 as the gripper device 124 is being positioned for gripping a drill pipe (because drill pipes of a drill string are not always perfectly, vertically aligned as extending from the ground).

An upper or piston end of the lower fluid actuator 146 includes a piston head 152 (FIGS. 3B-4B) that is slidably movable through the lower fluid housing 142 of the primary hydraulic housing 138 upon the application of hydraulic fluid pressure that causes movement of the lower fluid actuator 146 between retracted and expanded or extended positions, as further discussed below.

The back-up wrench device 108 can further comprise a second or upper fluid actuator 154. In one example, the upper fluid actuator 154 can comprise a coupling member 156 (FIG. 4B) rotatably coupled to a pair of support flanges 158 (FIG. 3B) of the outer housing 130 that each have an aperture that receives respective posts 160 of the coupling member 156. Thus, the upper fluid actuator 154 is "pinned" to the outer housing 130 to allow some relative rotational movement (about a rotational axis) of the gripper device 124 relative to the support structure 112 as the gripper device 124 is being positioned for gripping a drill pipe. A lower or piston end of the upper fluid actuator 154 includes a piston head 162 that is slidably movable through the upper fluid housing 140 of the primary hydraulic housing 138 upon the application of hydraulic fluid pressure that causes movement of the upper fluid actuator 154 between retracted and expanded positions, as discussed below.

A hydraulic system 151 (see specifically FIG. 4A) can be included and configured to actuate or facilitate movement of the lower fluid actuator 146 and, independently, the upper fluid actuator 154. The hydraulic system 151 can comprise a hydraulic mechanism 164 that can include one or more hydraulic pumps, manifold(s), fluid lines, valves, regulators, etc. In one example, the primary hydraulic housing 138 comprises a partition manifold structure 166 that separates the upper and lower fluid housings 140 and 142, and consequently that separates the piston head 152 of the lower fluid actuator 146 and the piston head 162 of the upper fluid actuator 154.

Figure 4A:
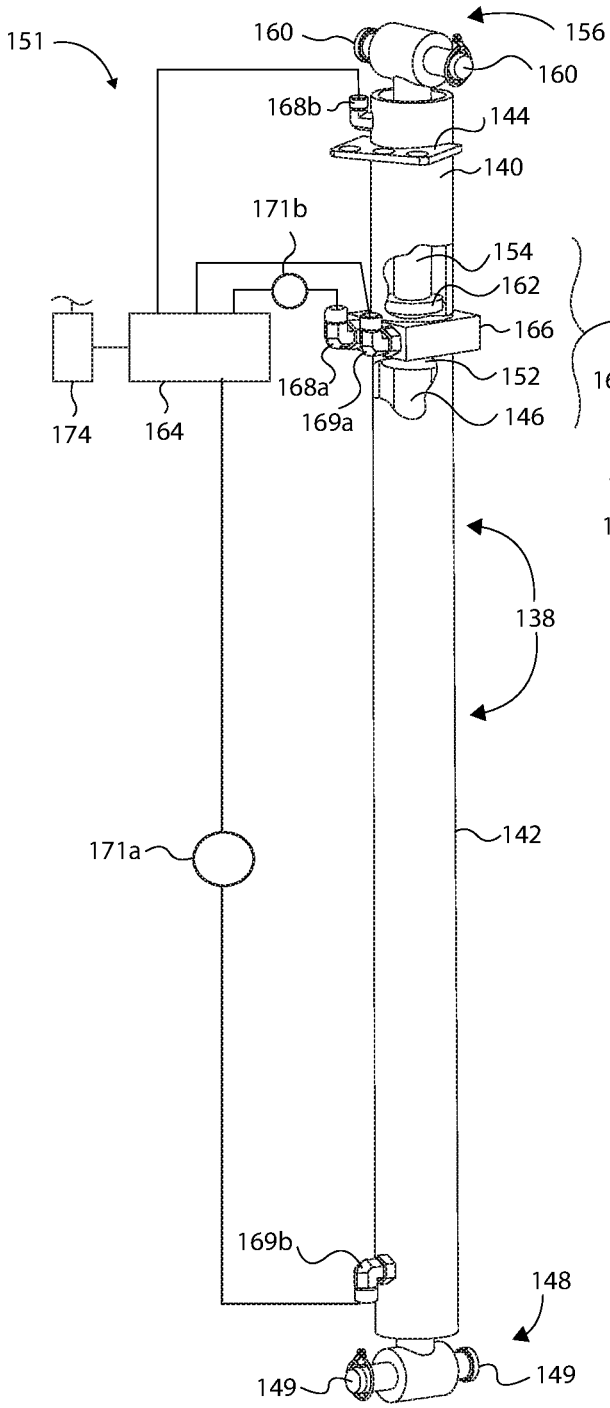
FIG. 4A is an isometric view of a hydraulic housing and a hydraulic system of the back-up wrench of FIG. 3A in accordance with an example of the present disclosure.
Figure 4B:
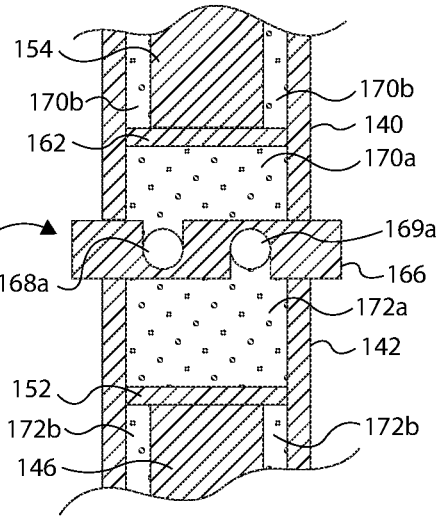
FIG. 4B is a detailed cross-sectional view of a portion of the hydraulic housing of FIG. 4A.

The partition manifold structure 166 can comprise a first hydraulic port 168*a* in fluid communication with a lower chamber 170*a* of the upper fluid housing 140, and a second hydraulic port 169*a* in fluid communication with an upper chamber 172*a* of the lower fluid housing 142, The primary hydraulic housing 138 can further comprise a third hydraulic port 168*b* in fluid communication with an upper chamber 170*b* of the upper fluid housing 140, and a fourth hydraulic port 169*b* in fluid communication with a lower chamber 172*b* of the lower fluid housing 142. As best illustrated in the cross sectional view of FIG. 4B, the piston head 162 of the upper fluid actuator 154 fluidly separates (i.e., seals off) the upper and lower chambers 170*a* and 170*b* of the upper fluid housing 140. Likewise, the piston head 152 of the lower fluid actuator 146 fluidly separates the upper and lower chambers 172*a* and 172*b* of the lower fluid housing 142. For purposes of illustration, note that the positions of the respective piston heads 152 and 162 are shown in FIG. 4B as being positioned away from the partition manifold structure 166 in order to show the various fluid chambers discussed above, but in practice during makeup and breakout the piston heads 152 and 162 may be in the positions shown in the figures discussed below.

An upper seal device (not shown) can be disposed in the upper fluid housing 140 adjacent hydraulic port 168*b* to seal off fluid contained in the upper chamber 170*b*. Likewise, a lower seal device can be disposed in the lower fluid housing 142 adjacent hydraulic port 169*b* to seal off fluid contained in the lower chamber 172*b*.

The hydraulic mechanism 164 is fluidly coupled to each of the hydraulic ports 168*a*, 168*b*, 169*a*, and 169*b* via fluid lines for transferring fluid to or from respective chambers (170*a*, 170*b*, 172*a*, 172*b*) of the primary hydraulic housing 138. The hydraulic mechanism 164 can be coupled to a hydraulic control system 174 for controlling operation of the hydraulic mechanism 164. The hydraulic control system 174 can be a computer system and/or a manual control panel. In one example, an operator controls the hydraulic mechanism 164 via a plurality of computer controlled commands executable via the hydraulic control system 174 for separate control and actuation of each of the upper fluid actuator 154 and the lower fluid actuator 146 between their respective expanded and retracted positions, as further discussed below. In another example discussed below, the lower fluid actuator 146 may be actuated automatically or passively upon threadably disengaging the threaded pin 118 from the drill pipe 106 during breakout operations, for instance.

Operating hydraulic pumps and related mechanisms is well known and will not be discussed in great detail. However, in one example hydraulic ports 168*a* and 168*b* can be fluidly coupled in a closed loop hydraulic system (e.g., via a hydraulic pump) such that fluid pressure can be supplied via hydraulic port 168*a* and concurrently removed via hydraulic port 168*b* to cause movement of the upper fluid actuator 154 from the retracted position and the expanded position, whether actively actuated by a hydraulic pump or passively actuated due to fluid pressure applied to the upper fluid actuator 154, as further detailed below. Similarly, hydraulic ports 169*a* and 169*b* can be fluidly coupled in a closed loop hydraulic system (e.g., via a hydraulic pump) such that fluid pressure can be supplied via hydraulic port 169*a* and concurrently removed via hydraulic port 169*b* to cause movement of the lower fluid actuator 146, such as from the retracted position to the expanded position, whether actively actuated by a hydraulic pump or passively actuated due to fluid pressure applied to the lower fluid actuator 146, as further detailed below.

With reference to FIGS. 1-50, the top drive assembly 104 (and its threaded pin 118) can be moved relative to the gripper device 124 during makeup and breakout operations by controlling the hydraulic mechanism 164 to actuate the lower fluid actuator 146 or the upper fluid actuator 154 or both. Specifically, and in one example, during breakout operations the lower fluid actuator 146 can be moved from the retracted position to the expanded position (FIG. 5A) by supplying fluid pressure into the upper chamber 172*a* via hydraulic port 169*a*. Thus, fluid pressure is exerted against/above the piston head 152 to downwardly move the lower fluid actuator 146 through the primary hydraulic housing 138 relative to the outer housing 130 (and relative the attached support structure 112). In one example involving passive actuation of the lower fluid actuator 146 during breakout operations, a rod-side relief valve 171*a* can be in fluid communication with fluid in the lower chamber 172*b*, so that upon sufficient fluid pressure in the upper chamber 172*a* (thereby downwardly biasing the piston head 152), the rod-side relief valve 171*a* is caused to be opened to permit removal of fluid from the lower chamber 172*b*, thereby permitting the lower fluid actuator 146 to move to the extended position. The "sufficient fluid pressure" is the result of the force applied to the fluid in the upper chamber 172*a* as a result of the threaded pin 118 being threadably disengaged from the drill pipe 106. That is, the axial movement of the top drive assembly 104 away from the drill pipe 106, due to being threadably disengaged therefrom, causes an increase in pressure in the fluid in the upper chamber 172*a*, which causes downward movement or actuation of the lower fluid actuator 146 concurrently along with axial displacement of the threaded pin 118 away from the drill pipe 106. During these breakout operations, the upper fluid actuator 154 may be in the extended position (until makeup operations are performed, as detailed below). After disengagement of the threaded pin 118 from the drill pipe 106, the top drive assembly 104 can be hoisted upwardly to further cause downward movement of the lower fluid actuator 146 to the position shown in FIG. 5A. Such downward movement of the lower fluid actuator 146 can extend the gripper device 124 relatively far away from the threaded pin 118. It is noteworthy to mention that, in this position, additional mud valves can be attached to the main shaft, and servicing can be performed on the system.

During makeup operations, the threaded pin 118 (e.g., male configuration having acme threads) is positioned near a threaded end 176 (e.g., female configuration having acme threads) of the drill pipe 106, then the main shaft 116 can be rotated to "makeup" or threadably engage the threaded pin 118 to the drill pipe 106, while the gripper device 124 grips the drill pipe 106 (as discussed above). During such threadable engagement, the upper fluid actuator 154 can be moved from the expanded position (FIG. 5B) to the retracted position (FIG. 5C) by supplying fluid pressure into the upper chamber 170*b* via hydraulic port 168*b* while removing fluid from the lower chamber 170*a*. Such transfer of fluid via ports 168*a* and 168*b* can be performed actively via manual control or programmed control that removes and supplies fluid pressure to respective chambers 170*b* and 170*a*, or it can be performed passively via relief valves.

For instance, a piston-side relief valve 171*b* can be in fluid communication with the lower chamber 170*a* via hydraulic port 168*a*, so that upon sufficient fluid pressure in the upper chamber 170*b* (thereby biasing downwardly the piston head 162), the piston-side relief valve 171*b* is caused to be opened to remove fluid from the lower chamber 170*a* to move the upper fluid actuator 154 from the extended position to the retracted position while the threaded pin 118 is being threadably engaged with the drill pipe 106 (i.e., makeup operations).

Advantageously, in this manner the upper fluid actuator 154 compensates for thread travel (between the threaded pin 118 and the threaded end 176 of the drill pipe 106) during makeup operations, as outlined above. And, the lower fluid actuator 146 can compensate for thread travel during breakout operations, as outlined above. However, in one example, only one fluid actuator may be used during both breakout and makeup operations. For instance, only the lower fluid actuator 146 may be incorporated into a single chamber hydraulic housing/cylinder for both breakout and makeup operations. In this example, more precise manual control over the position of the lower fluid actuator 146 via a hydraulic system controller may be required to properly coordinate movement of the fluid actuator with the axial movement of the top drive assembly relative to a drill pipe.

In some examples, the aforementioned "thread travel" can be several inches (e.g., a thread distance of approximately 2.5 inches, which is the thread height of typical acme threads used in many borehole drilling applications). However, the thread distance can vary depending on the particular thread height of a drill pipe, such as about 1 inch up to 5 inches or more of thread travel.

During makeup, once the threaded pin 118 is fully engaged with the threaded end 176 of the drill pipe 106, the gripper device 124 is caused to release gripping pressure from the drill pipe 106, and then the main shaft 116 is rotated clockwise to threadably engage a lower threaded male end (not shown) of the drill pipe 106 to a stump. Downhole drilling operations then continue on the drill string (e.g., about 90 feet downwardly) until the upper end of a drill pipe 106 is again extending out of the ground surface. Then, the gripper device 124 is engaged to again grip the drill pipe 106, and then the main shaft 116 is rotated counter clockwise until the threaded pin 118 is disengaged from the threaded end 176 of the drill pipe 106 (i.e., breakout of the drill pipe). After breakout of the drill pipe 106, the upper fluid actuator 154 can be hydraulically actuated back to its expanded position via active actuation, such as by a manual operator. Thus, the upper fluid actuator 154 can be ready and positioned for makeup of another drill pipe during normal drilling operations.

Upon contacting the drill pipe 106, the main shaft 116 can be axially movable or can axially "float" during makeup and breakout to avoid damage to the threaded pin 106 and the main shaft 116, which can be achieved via springs or other compliant devices that allow the main shaft 116 to float in this manner.

Thus, during breakout operations, the lower fluid actuator 146 can be simultaneously hydraulically actuated from the retracted position to the expanded position in a coordinated manner as the threaded pin 118 is disengaged from the drill pipe 106 to breakout the top drive assembly 104. The gripper device 124 can then be operated to release gripping pressure, and then another section of a drill pipe (e.g., from inventory/stack) can be hoisted up by the top drive assembly 104. The makeup process described above (regarding FIGS. 5A-5C) can be repeated for the new drill pipe to be coupled with the drill pipe 106 as part of the drill string, and this can be repeated for hundreds of drill pipes during downhole drilling operations.

Advantageously, the lower and upper fluid actuators 146 and 154 re housed or contained entirely inside the walls of the inner and outer housings 128 and 130, which prevents mud and other debris from interfering with proper operation of the fluid actuators 146 and 154. Another advantage is that the upper actuator 154 is positioned at an upper end of the back-up wrench 108, at a location relatively far away and distal from the gripper device 124 where mud typically abounds during makeup and breakout. This further minimizes the amount of debris that could affect operation of the upper fluid actuator 154.

Figure 6:
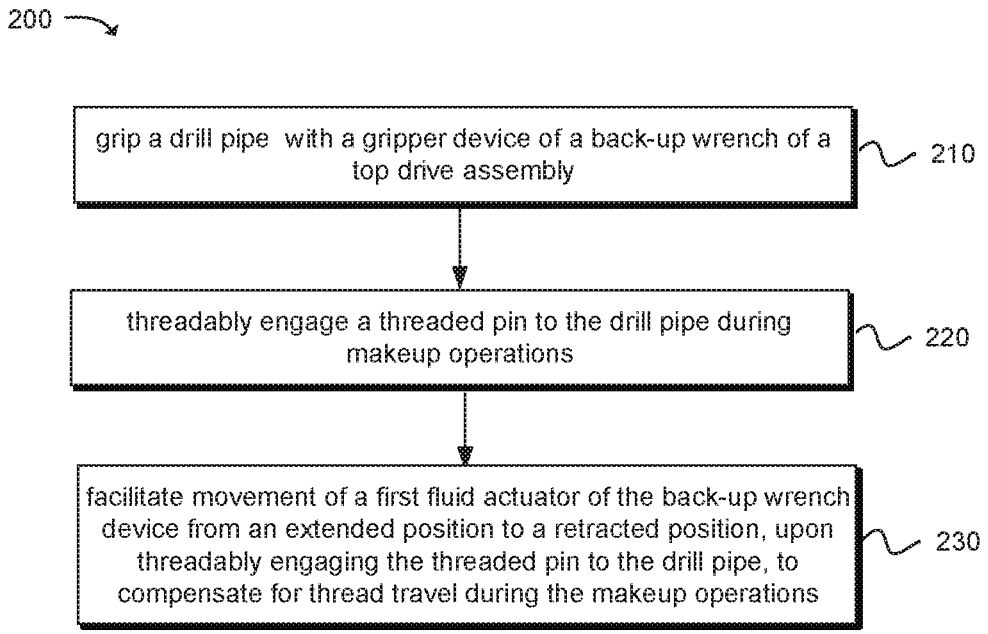
FIG. 6 illustrates a method of operating a back-up wrench in accordance with an example of the present disclosure.

FIG. 6 illustrates a method 200 for thread compensation for a back-up wrench device of a top drive assembly of a drilling rig in accordance with an example of the present disclosure. At operation 210, the method comprises gripping a drill pipe (e.g., 106) with a gripper device (e.g., 124) of a back-up wrench (e.g., 108) of a top drive assembly (e.g., 104), such as described above regarding the devices and method used for gripping a drill pipe. At operation 212, the method comprises threadably engaging a threaded pin (e.g., 118) of the top drive assembly during makeup operations. This can be achieved by operating the motor and main shaft discussed above regarding the top drive assembly of FIGS. 1-50. At operation 214, the method comprises facilitating movement of a first fluid actuator (e.g., 154) of the back-up wrench device from an extended position to a retracted position, upon threadably engaging the threaded pin to the drill pipe, to compensate for thread travel during the makeup operations. This can be achieved with the devices and methods discussed regarding FIGS. 3A-5C.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A back-up wrench device of a top drive assembly useable on a drilling rig, comprising:

a first housing coupleable to a support structure of the top drive assembly of the drilling rig;

a second housing movably coupled to the first housing;

a primary hydraulic housing coupled to each of the first and second housings, the primary hydraulic housing comprising a lower fluid housing and an upper fluid housing fluidly separated from each other;

a gripper device coupled to the second housing and operable to grip a drill pipe during makeup or breakout operations via the top drive assembly; and at least one fluid actuator coupled to one of the first housing or the second housing, a lower fluid actuator movable through the lower fluid housing, and an upper fluid actuator movable through the upper fluid housing, and wherein, during makeup or breakout operations, at least one of the lower and upper fluid actuators is movable to compensate for thread travel.

2. The back-up wrench of claim 1, wherein at least one of the lower and upper fluid actuators is configured to move between an extended position and a retracted position during the makeup or breakout operations.

3. The back-up wrench of claim 2, wherein at least one of the lower and upper fluid actuators is configured to automatically move between the extended position and the retracted position via operation of a hydraulic system due to fluid pressure acting on at least one of the lower and upper fluid actuators during the makeup or breakout operations.

4. The back-up wrench of claim 1, wherein the first and second housings are translatable relative to each other, wherein at least one of the first and second housings encloses at least one of the lower and upper fluid actuators.

5. The back-up wrench of claim 1, wherein the lower fluid actuator has a rod end coupled to the second housing and a piston end moveable through the lower fluid housing, and wherein the upper fluid actuator has a rod end coupled to the first housing and a piston end moveable through the upper fluid housing.

6. The back-up wrench of claim 1, wherein the lower fluid actuator is configured to move between an extended position and a retracted position upon movement of the first housing relative to the second housing during makeup or breakout operations to compensate for thread travel.

7. The back-up wrench of claim 1, wherein the primary hydraulic housing comprises a partition manifold structure that separates a piston head of the upper fluid actuator and a piston head of the lower fluid actuator, wherein the partition manifold structure comprises a first hydraulic port in fluid communication with the upper fluid housing and a second hydraulic port in fluid communication with the lower fluid housing to facilitate hydraulic actuation of each of the upper and lower fluid actuators.

8. The back-up wrench of claim 7, wherein the primary hydraulic housing comprises a third hydraulic port in fluid communication with the upper fluid housing, whereby the piston head of the upper fluid actuator is disposed between the first and third hydraulic ports, and wherein the primary hydraulic housing comprises a fourth hydraulic port in fluid communication with the lower fluid housing, whereby the piston head of the lower fluid actuator is disposed between the second and fourth hydraulic ports.

9. A top drive system for use on a drilling rig, comprising:

a top drive assembly movably coupleable to a rig support frame of a drilling rig, the top drive assembly comprising a threaded pin that is operable to rotatably engage and disengage a threaded end of a drill pipe during respective makeup and breakout operations; and a back-up wrench device coupled to the top drive assembly, comprising:

a gripper device operable to grip the drill pipe;

a first housing coupled to a support structure of the top drive assembly;

a second housing coupled to the gripper device, and movably coupled to the first housing;

at least one fluid actuator operable to compensate for thread travel between the threaded pin of the top drive assembly and the drill pipe during makeup or breakout operations;

a primary hydraulic housing coupled to each of the first and second housings, such that the first and second housings enclose the primary hydraulic housing, the at least one fluid actuator being movable through a fluid chamber of the primary hydraulic housing during the makeup or breakout operations, wherein the at least one fluid actuator comprises a piston head that separates the fluid chamber into an upper fluid chamber and a lower fluid chamber of the primary hydraulic housing, and wherein upon fluid pressure being applied to one of the lower or upper fluid chambers during makeup or breakout operations, the piston head moves through the fluid chamber of the primary hydraulic housing to compensate for thread travel; and a hydraulic system operatively coupled to the upper and lower fluid chambers of the primary hydraulic housing, the hydraulic system comprising a first relief valve fluidly coupled to the upper fluid chamber, and a second relief valve fluidly coupled to the lower fluid chamber, wherein breakout operations cause the piston head to move downwardly, thereby causing fluid in the lower fluid chamber to move through the second relief valve, and wherein makeup operations cause the piston head to move upwardly, thereby causing fluid in the upper fluid chamber to move through the first relief valve.

10. The top drive system of claim 9, wherein the at least one fluid actuator is configured to move between an extended position and a retracted position upon fluid pressure acting on the at least one fluid actuator during makeup or breakout operations.

11. The top drive system of claim 9, wherein the at least one fluid actuator comprises a lower fluid actuator and an upper fluid actuator, wherein the primary hydraulic housing comprises a partition manifold structure that defines an upper fluid housing and a lower fluid housing, wherein the upper fluid actuator is movable through the upper fluid housing, and the lower fluid actuator is moveable through the lower fluid housing.

12. The top drive system of claim 11, wherein the lower fluid actuator has a rod end coupled to the second housing and a piston end moveable through the lower fluid housing, and wherein the upper fluid actuator has a rod end coupled to the first housing and a piston end moveable through the upper fluid housing.

13. The top drive system of claim 11, wherein one of the upper and lower fluid actuators is automatically moveable about the primary hydraulic housing upon a hydraulic force being applied to one of the upper and lower fluid actuators resulting from a force applied by the top drive assembly during makeup or breakout operations.

14. A top drive system for use on a drilling rig, comprising:

a top drive assembly comprising a threaded pin that is operable to rotatably engage and disengage a threaded end of a drill pipe during respective makeup operations and breakout operations associated with the top drive assembly and the drill pipe; and a back-up wrench device comprising:

a gripper device operable to grip the drill pipe;

a first housing coupled to a support structure of the top drive assembly;

a second housing coupled to the gripper device, and movably coupled to the first housing; and a primary hydraulic housing movably coupled to each of the first and second housings, the primary hydraulic housing comprising an upper fluid chamber and a lower fluid chamber;

an upper fluid actuator coupled to the first housing, and movable through the upper fluid chamber, the upper fluid actuator operable to move from an extended position to a retracted position to compensate for thread travel between the threaded pin of and the drill pipe during makeup operations; and a lower fluid actuator coupled to the second housing, and movable through the lower fluid chamber, the lower fluid actuator operable to move from a retracted position to an extended position to compensate for thread travel during breakout operations.

15. The top drive system of claim 14, further comprising a hydraulic system operatively coupled to the upper and lower fluid chambers of the primary hydraulic housing, the hydraulic system operable to facilitate actuation of each of the upper and lower fluid actuators.

16. The top drive system of claim 14, wherein the lower fluid actuator has a rod end coupled to the second housing and a piston end moveable through the lower fluid housing, and wherein the upper fluid actuator has a rod end coupled to the first housing and a piston end moveable through the upper fluid housing.

17. The top drive system of claim 14, wherein, upon threadably disengaging the threaded pin from the drill pipe during breakout operations, the top drive assembly is operable to move upwardly away from the drill pipe, thereby causing the lower fluid actuator to automatically move through the lower fluid chamber due to fluid pressure applied to the lower fluid actuator.

18. The top drive system of claim 14, wherein, upon threadably engaging the threaded pin to the drill pipe during makeup operations, the top drive assembly is operable to move downwardly toward the drill pipe, thereby causing the upper fluid actuator to automatically move through the upper fluid chamber due to fluid pressure applied to the upper fluid actuator.

19. A method for facilitating thread compensation with a back-up wrench device of a top drive assembly of a drilling rig, comprising:

gripping a drill pipe with a gripper device of a back-up wrench of the top drive assembly;

threadably engaging a threaded pin to the drill pipe during makeup operations; and facilitating movement of a lower fluid actuator of the back-up wrench, the lower fluid actuator being movable through a lower fluid housing of a primary hydraulic housing;

facilitating movement of an upper fluid actuator of the back-up wrench, the upper fluid actuator being movable through an upper fluid housing of the primary hydraulic housing, wherein at least one of the lower and upper fluid actuators is movable from an extended position to a retracted position, upon threadably engaging the threaded pin to the drill pipe, to compensate for thread travel during the makeup operations.

20. The method of claim 19, further comprising threadably disengaging the threaded pin from a threaded end of the drill pipe during breakout operations, and facilitating movement of at least one of the lower or upper fluid actuators of the back-up wrench device from the retracted position to the extended position, upon threadably disengaging the threaded pin from the drill pipe, to compensate for thread travel during the breakout operations.

21. The method of claim 19, wherein facilitating movement of at least one of the lower or upper fluid actuators further comprises operating a hydraulic system fluidly coupled to the primary hydraulic housing of the back-up wrench, wherein at least one of the lower or upper fluid actuators is movable through a respective lower or upper fluid chamber of the primary hydraulic housing during makeup or breakout operations.

22. The method of claim 19, further comprising facilitating automatic movement of at least one of the lower or upper fluid actuators during breakout operations as a result of fluid pressure acting on at least one of the lower or upper fluid actuators due to the threaded pin being threadably disengaged from the drill pipe.

23. The method of claim 19, further comprising operating a hydraulic system to move at least one of the lower or upper fluid actuators from the retracted position to the extended position, and between makeup and breakout operations to reset at least one of the lower or upper fluid actuators to the extended position.

24. A top drive system for use on a drilling rig, comprising:

a top drive assembly movably coupleable to a rig support frame of a drilling rig, the top drive assembly comprising a threaded pin that is operable to rotatably engage and disengage a threaded end of a drill pipe during respective makeup and breakout operations; and a back-up wrench device coupled to the top drive assembly, comprising:

a gripper device operable to grip the drill pipe;

a first housing coupled to a support structure of the top drive assembly;

a second housing coupled to the gripper device, and movably coupled to the first housing;

at least one fluid actuator operable to compensate for thread travel between the threaded pin of the top drive assembly and the drill pipe during makeup or breakout operations; and a primary hydraulic housing coupled to each of the first and second housings, such that the first and second housings enclose the primary hydraulic housing, the at least one fluid actuator being movable through a fluid chamber of the primary hydraulic housing during the makeup or breakout operations, wherein the at least one fluid actuator comprises a lower fluid actuator and an upper fluid actuator, wherein the primary hydraulic housing comprises a partition manifold structure that defines an upper fluid housing and a lower fluid housing, wherein the upper fluid actuator is movable through the upper fluid housing, and the lower fluid actuator is moveable through the lower fluid housing.

* * * * *